US006920835B1

(12) United States Patent
Johnson

(10) Patent No.: US 6,920,835 B1
(45) Date of Patent: Jul. 26, 2005

(54) CHARITY COLLECTION SAFE

(75) Inventor: Robert Johnson, Limerick, PA (US)

(73) Assignee: Perma-Vault Safe Co., Warminster, PA (US)

( * ) Notice: Subject to any disclaimer, the term of this patent is extended or adjusted under 35 U.S.C. 154(b) by 0 days.

(21) Appl. No.: 10/844,634

(22) Filed: May 13, 2004

Related U.S. Application Data

(60) Provisional application No. 60/470,389, filed on May 14, 2003.

(51) Int. Cl.[7] ..... E06B 7/00

(52) U.S. Cl. ..... 109/68; 109/59 R; 232/43.1; 232/54; 232/15

(58) Field of Search ..... 109/45–49, 50–57, 109/58–60, 64, 66–68; 232/10, 15, 16, 43.1, 232/43.4, 54

(56) References Cited

U.S. PATENT DOCUMENTS

| | | | | | |
|---|---|---|---|---|---|
| 450,379 | A | * | 4/1891 | Sinclaire | 232/51 |
| 461,208 | A | * | 10/1891 | Markell | 232/39 |
| 492,564 | A | * | 2/1893 | Smith | 232/24 |
| 555,948 | A | * | 3/1896 | Harrison | 232/49 |
| 622,229 | A | * | 4/1899 | Hutchinson | 232/15 |
| 626,251 | A | * | 6/1899 | Teevan | 232/54 |
| 722,323 | A | * | 3/1903 | Parker | 232/54 |
| 1,048,409 | A | * | 12/1912 | Hoskins | 232/54 |
| 2,658,667 | A | * | 11/1953 | Mirkin | 232/23 |
| 2,703,200 | A | * | 3/1955 | Harris | 232/43.3 |
| 2,742,994 | A | * | 4/1956 | Towner | 193/34 |
| 3,036,758 | A | * | 5/1962 | Greenbank et al. | 232/44 |
| 3,292,849 | A | * | 12/1966 | Ewing | 232/43.2 |
| 3,927,792 | A | * | 12/1975 | Andrade et al. | 220/210 |
| 4,176,610 | A | * | 12/1979 | Markham et al. | 109/59 R |
| 4,312,277 | A | | 1/1982 | Graef et al. | 109/24.1 |
| 4,452,390 | A | * | 6/1984 | West | 232/4 R |
| 4,573,416 | A | | 3/1986 | Masachika | 109/66 |
| 5,137,212 | A | * | 8/1992 | Fiterman et al. | 232/43.2 |
| 5,449,111 | A | * | 9/1995 | Sauzedde et al. | 232/17 |
| 5,607,102 | A | * | 3/1997 | Walsh et al. | 232/1 D |
| 5,607,103 | A | * | 3/1997 | Boling, Jr. | 232/17 |
| 5,734,325 | A | | 3/1998 | Johnson et al. | 340/568 |
| 6,244,505 | B1 | * | 6/2001 | Grimes et al. | 232/47 |
| 6,347,737 | B1 | * | 2/2002 | Madruga | 232/47 |
| 6,644,542 | B2 | * | 11/2003 | Cox et al. | 232/47 |

* cited by examiner

*Primary Examiner*—Suzanne Dino Barrett
(74) *Attorney, Agent, or Firm*—Young & Basile, P.C.

(57) ABSTRACT

A collection safe is provided, especially for charitable donations, for installation in a wall of a building. The collection safe has a rectangular box formation and includes a first door on one side of the box for receiving donations and a second door on the opposing side of the box to provide access to the interior. The first door is connected to a pair of side walls which extend into the interior of the box. A baffle extends and is connected to the side walls so that the baffle is oriented 90° relative to the first door. The baffle has a free end with a jagged edge such as sharp teeth that terminates less than one inch from the first door to deter the retrieval of the donations from the first door. The space between the jagged edge of the baffle and the first door provides a slot for receiving the donation past the baffle to the floor of the collection safe.

12 Claims, 3 Drawing Sheets

CHARITY COLLECTION SAFE

This application claims priority of U.S. Provisional Patent Application Ser. No. 60/470,389 filed on May 14, 2003.

BACKGROUND OF THE INVENTION

The invention relates to a collection safe for installation in a wall of a building. In particular, the invention relates to a collection safe where selective access to the interior of the safe is available from outside of the building as well as the inside of the building.

Devices that collect donations for charities are well known. These devices are usually positioned in selected locations that are convenient to donators for soliciting donations. Typically, fund-raising collection receptacles are placed near a cash register in a retail store with printed advertising asking the customer to donate. However, these collection receptacles must be monitored by the employees or volunteers to prevent theft. In addition, these receptacles are only capable of receiving donations when the establishment is open. Therefore, it would be advantageous for charities to have a collection safe that is capable of receiving donations at any time of day, as well as a collection safe that provides security of the contents from theft.

SUMMARY OF THE INVENTION

It is the intent of the present invention to address the aforementioned concerns. In a first aspect of the invention, a charity collection safe is provided having a rectangular box with a hollow interior for storing contents and a first door in one side of the box and a second door in an opposing side of the box, wherein the first and second doors are selectively openable and the first door has means for deterring the retrieval of the contents in the hollow interior via access of the first door.

In another aspect of the invention, the charity collection safe, further includes a baffle located in the hollow interior wherein the baffle together with the first door forms a slot therebetween for receiving contributions.

In yet another aspect of the invention, the means for deterring retrieval of the content includes a series of sharp teeth formed on an edge of the baffle.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
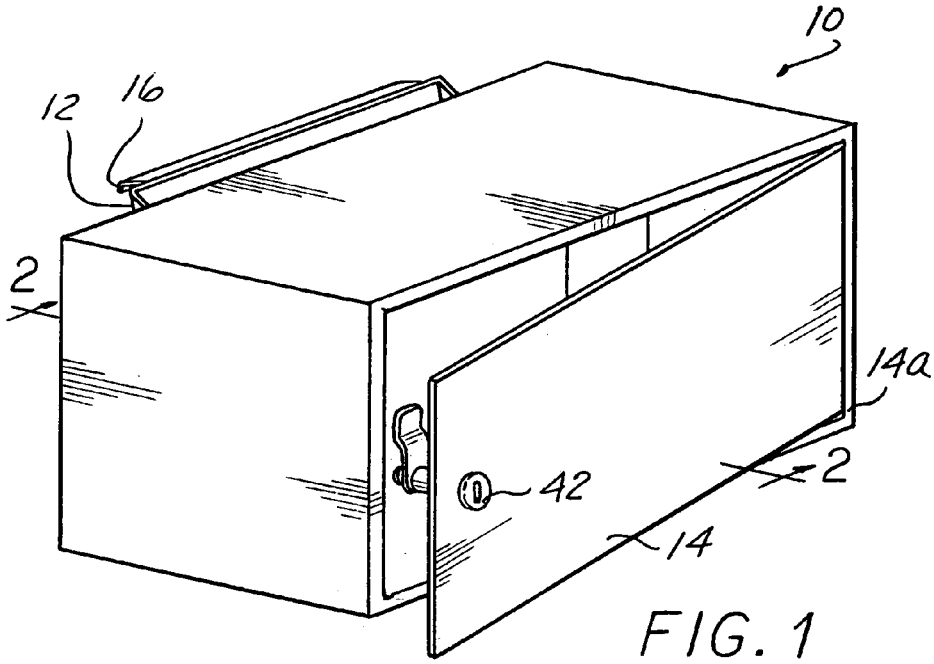
FIG. 1 is a perspective view of a schematic drawing of the collection safe according to the present invention.

The collection safe 10 of the present invention as shown in FIGS. 1–7 has a box configuration which is sized to be installed in the space of a conventional concrete block used in the construction of buildings. The collection safe 10 can be mortared directly into the building in the place of a concrete block to prevent easy removal and theft of the contents. The depth of the collection safe 10 is configured so that when the collection safe 10 is installed into the building, one side 12*a* of the safe 10 is accessible to the exterior of the building and the opposing side 14*a* of the safe is accessible to the interior of the building. A typical depth of the collection safe 10 is 9.0–10.0 inches. The illustrated embodiment shows a collection safe 10 having a depth of 9.75 inches. However, the depth can be varied to accommodate other wall thicknesses.

The collection safe 10 includes an exterior door 12 that is exposed from the exterior of the building, and an interior door 14 opening to the interior of the building. The exterior door 12 has an upper lip 16 extending along the upper periphery 13 of the door 12 for gripping during the opening process. Looking at the cutaway side view of the collection safe 10 in FIG. 2, it can be seen that the exterior door 12 extends nearly the entire length of the collection safe 10 and pivots about the hinge 18 at a central portion of the exterior door 12. The hinge 18 preferably allows for 360° pivotal movement of the exterior door 12. However, full pivotal movement of the exterior door 12 is restricted by the interior configuration of the exterior door 12, which is explained hereinafter.

Figure 2:
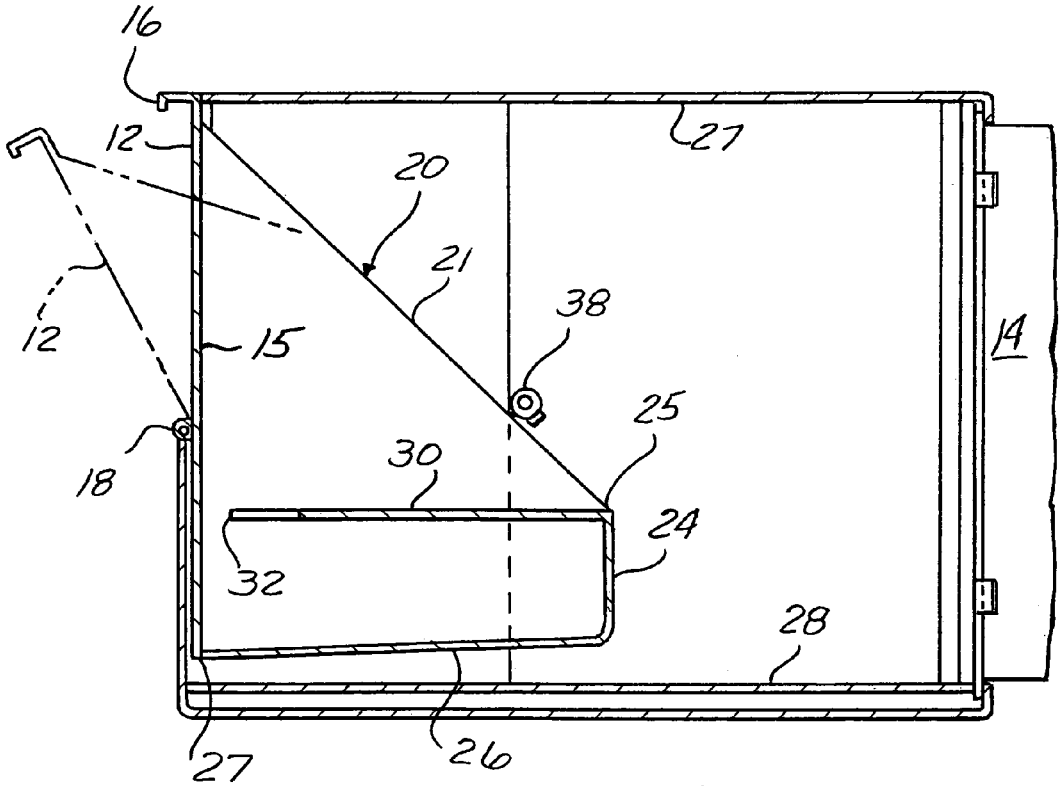
FIG. 2 is a sectional view of FIG. 1 taken along lines 2—2.
Figure 3:
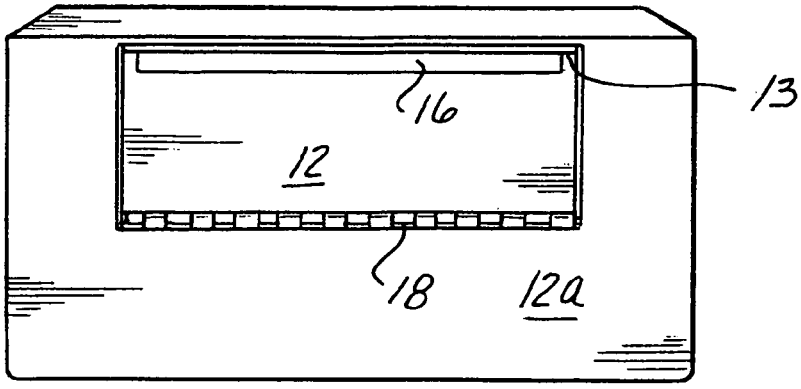
FIG. 3 is a front view of the collection safe showing the exterior door in the closed position.
Figure 4:
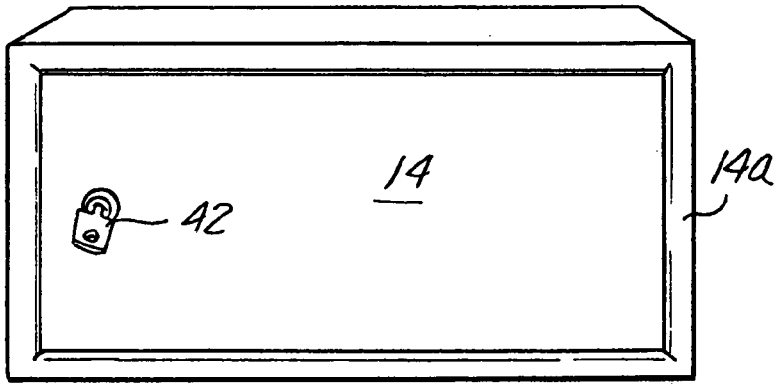
FIG. 4 is a rear view of the collection safe showing the interior door in a closed position.
Figure 6:
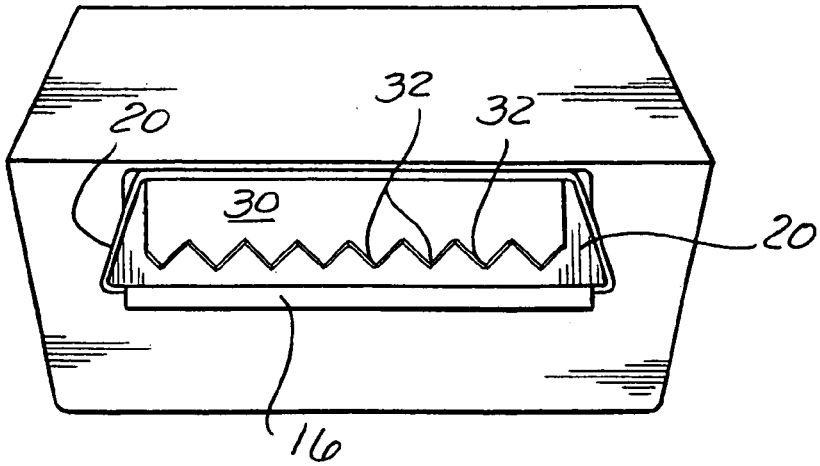
FIG. 6 is a perspective view of the collection safe showing the exterior door in a open position.
Figure 5:
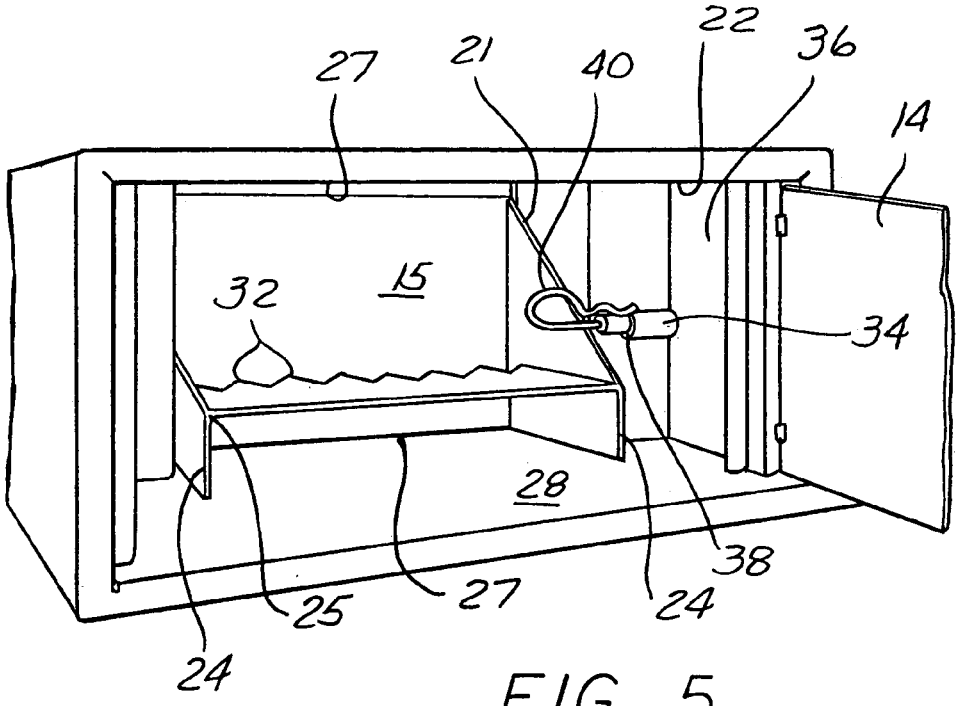
FIG. 5 is a perspective view of the interior of the collection safe from the rear when the interior door is in the open position.

Looking at especially FIGS. 2 and 5, the lateral edges of the exterior door 12 have side or lateral walls 20 extending into the interior cavity 22 of the collection safe 10. In the illustrated embodiment, the angled portion 21 of the lateral walls 20 start approximately three eighths of an inch below the upper peripheral edge 13 of the exterior door 12. The lateral walls 20 slope at essentially a 45 degree angle downwardly for a portion and then extends vertically downwardly along a vertical edge 24. When the exterior door 12 is in the closed position, the vertical edge 24 is approximately equidistant between the exterior 12 and interior doors 14. The vertical edge 24 of the lateral walls 20 of the exterior door 12 terminate approximately ½ inch above the floor 28 of the interior cavity 22. (In the illustrated embodiment shown in FIG. 2, the lateral walls 20 terminate ⅜ inch above the floor 28.) As can be seen in FIG. 2, the lateral walls 20 start the vertical slope below the horizontal level of the hinge 18. The point 25 on the lateral walls 20 where the angled portions 21 of the walls 20 meet the vertical edges 24 provides a stop for the movement of the exterior door 12. The exterior door 12 is restricted from further movement in the opening position when the points 25 on the lateral walls 20 contact the roof 27 of the collection safe 10.

The vertical edges 24 of the lateral walls 20 terminate at an essentially horizontal lower edge 26 that is connected to the lower peripheral edge 27 of the exterior door 12. The essentially horizontal edge 26 of the lateral wall 20 preferably has a slight incline from the exterior door 12 to the vertical edge 24. As shown in FIG. 2 the essentially horizontal edge 26 inclines approximately one eighth inch from the exterior door 12 to the back vertical edge 24 over a span of approximately five inches. The slight incline of edges 26 facilitates locking the exterior door 12 in the open position.

A shelf or baffle 30 is connected between the two lateral walls 20. The baffle 30 is connected to the lateral walls 20 at the location where the angled edge 21 of a lateral wall 20 meets the vertical edge 24 of the lateral wall 20. The baffle 30 extends from the points 25 on the lateral walls 20 toward the exterior door 12. However, the baffle 30 terminates less than one inch and preferably approximately a half an inch from the exterior door 12 (as can be seen in FIG. 2). The termination edge 32 of the baffle 30 forms a series of sharp teeth 32, best seen in FIGS. 6 and 7. The sharp teeth 32 may have other configurations in order to deter retrieval of the contents of the collection safe 10 from the exterior door 12. However, the configurations of the termination edge 32 preferably include jagged edges. As stated supra, the termination edge 32 is spaced less than one inch and preferably approximately a half an inch away from the inside surface 15 of the exterior door 12. The space between the inside surface 15 of the exterior door 12 and the baffle 30 forms a slot for allowing monetary donations to slide between the baffle 30 and exterior door 12.

The space below the baffle 30 is opened to the floor 28 for retrieval of the donations through the interior door 14. FIG. 5 shows a view of the interior cavity 22 of the collection safe 10 when the exterior door 12 is in the closed position and the interior door 14 is in the open position. Any donations that have entered through the exterior door 12 will fall through the slot formed between the inside surface 15 of the exterior door 12 and the baffle 30 and onto the floor 28 of the collection safe 10.

Figure 7:
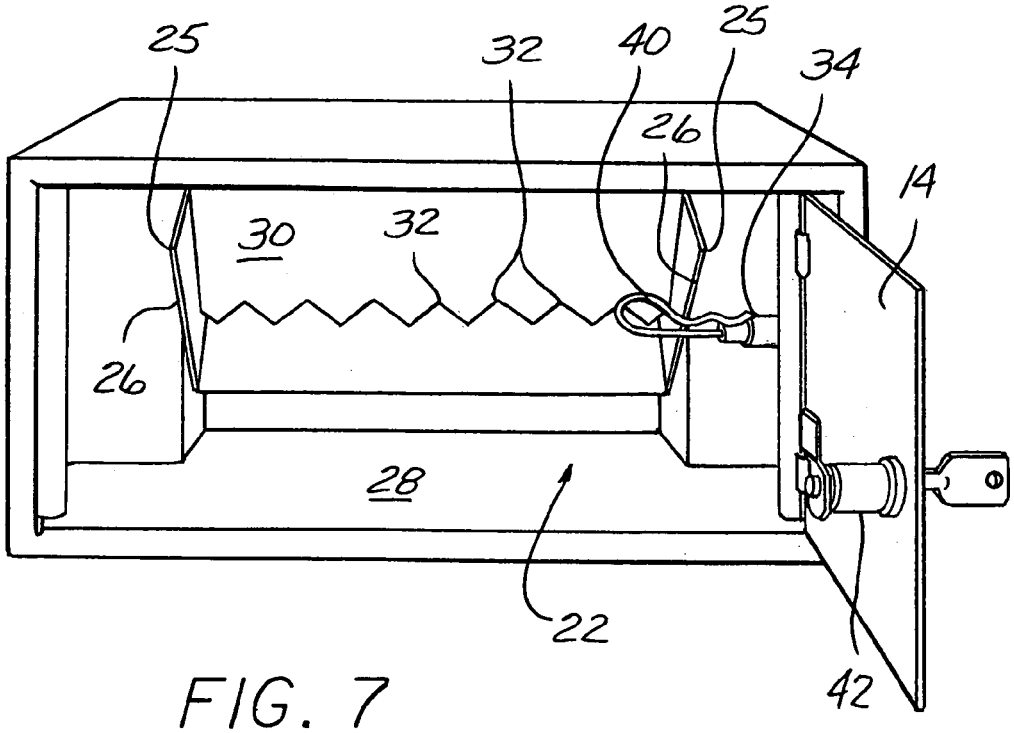
FIG. 7 is a interior view of the collection safe when the exterior and interior doors are in the open position.

The exterior door 12 can be selectively locked in the closed position, selectively locked in the open position, or allowed to be manually opened by a person on the outside of the building. A locking pin holder 34 is securely attached to a wall extension 36 located in the interior cavity 22 and adjacent one of the lateral walls 20 of the exterior door 12. The locking pin holder 34 has an aperture 38 for receiving a pin 40, such as shown in FIG. 5. The pin 40 may have various shapes, but is positioned to traverse and connect the angled portion 21 of one of the lateral side walls 20 of the exterior door to prevent movement of the exterior door 12 and to lock the exterior door 12 in the closed position. When the pin 40 is positioned within the pin holder 34 as shown in FIG. 5, and when the exterior door 12 is the closed position, the exterior door 12 can not be opened. When the exterior door 12 is in the open positioned, as shown in FIG. 7, the exterior door 12 can be locked in the open position by installing the pin 40 into the pin holder 34. Once the locking pin 40 is positioned within the pin holder 34, the pin 40 comes in contact with lower edge 26 so that exterior door 12 is locked in the open position. If it is desired that the exterior door 12 be manually operably opened and closed from outside the building, the locking pin 40 is removed from the locking pin holder 34.

The interior door 14 is a conventional hinged door having a lock and a key combination 42. The lock and key combination may be replaced with a lock and combination box. Both locking procedures for the interior door 14 are conventional. The interior door 14 allows access to the interior cavity 22 from the inside of the building. A person having access through the interior door can optionally lock or unlock the exterior door 12 in one of the aforementioned combinations. Further, the person having access through the interior door 14 can retrieve any donations from the interior cavity 22 in the collection safe 10 at any time, whether the exterior door 12 is opened or closed.

The collection box 10 of the present invention provides a convenient device for a charity or business to accept donations or other documents from the public. The collection box 10 is intended for installation within a wall of a building so that a volunteer of the charity or an employee of the business can easily retrieve any submitted donations or documents from inside the building. The collection box 10 also prevents theft of the contents from someone outside of the building. The narrow slot formed by the baffle 30, as well as the jagged edge 32 on the baffle 30, deters unauthorized people from gaining access to the contents within the collection box 10.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A charity collection safe, comprising: a rectangular box having a hollow interior for storing contents having a first door in one side of the box and a second door in an opposing side of the box; wherein said first and second doors are selectively openable, wherein the first door has means for deterring the retrieval of the contents in the hollow interior via access of the first door, wherein the first door has a pair of lateral side walls extending into the interior of the box and a baffle extending therebetween, wherein the baffle is oriented 90° from the first door and has a free end spaced less than one inch from the first door to provide a slot therebetween for receiving contributions.

2. The charity safe of claim 1, wherein the means for deterring retrieval of the contents includes a series of sharp teeth formed on an edge of the baffle.

3. The charity safe of claim 1, wherein the first door can be selectively locked in a closed position.

4. The charity safe of claim 1, wherein the first door can be selectively locked in a closed position, selectively locked in an open position, and manually openable by a person.

5. The charity safe of claim 2, wherein the series of sharp teeth are formed on the free end of the baffle and said sharp teeth are spaced less than an inch from the first door for providing a slot therebetween for receiving contributions.

6. The charity safe of claim 1, wherein the first door pivots about a hinge connected to a center portion of the first door.

7. The charity safe of claim 1, wherein the free end of baffle has a jagged edge formed therein to provide the means for deterring the retrieval of the contents.

8. The charity safe of claim 7 further comprising a locking pin and locking pin holder for selectively locking the first door in one of the open and closed positions.

9. The charity safe of claim 8, wherein the locking pin holder is attached to one of the lateral side walls.

10. The charity safe of claim 1, wherein the first door extends nearly the entire length of the box.

11. The charity safe of claim 1, wherein the second door can be selectively locked in a closed position.

12. The charity safe of claim 1, wherein the locking mechanism is accessible only through the second door.

* * * * *